US005689078A

United States Patent [19]

McClard

[11] Patent Number: 5,689,078

[45] Date of Patent: Nov. 18, 1997

[54] MUSIC GENERATING SYSTEM AND METHOD UTILIZING CONTROL OF MUSIC BASED UPON DISPLAYED COLOR

[75] Inventor: Peter T. McClard, New York, N.Y.

[73] Assignee: Hologramaphone Research, Inc., New York, N.Y.

[21] Appl. No.: 496,887

[22] Filed: Jun. 30, 1995

[51] Int. Cl.[6] ..... G10H 7/00

[52] U.S. Cl. ..... 84/600; 84/645; 84/464 R

[58] Field of Search ..... 84/600, 645, 626, 84/DIG. 6, 464 R, 611, 612, 635, 636, 633

[56] References Cited

U.S. PATENT DOCUMENTS

| | | | |
|---|---|---|---|
| 5,048,390 | 9/1991 | Adachi et al. | 84/464 R |
| 5,159,140 | 10/1992 | Kimpara et al. | 84/600 |
| 5,286,908 | 2/1994 | Jungleib . | |
| 5,488,196 | 1/1996 | Zimmerman et al. . | |

*Primary Examiner*—William M. Shoop, Jr.
*Assistant Examiner*—Jeffrey W. Donels
*Attorney, Agent, or Firm*—Curtis, Morris & Safford, P.C.; William J. Spatz, Esq.

[57] ABSTRACT

An apparatus and method for generating music from color input data is disclosed. Color data extracted from a selected portion of a still or moving picture image displayed on a color graphical output means is converted by a central processing unit into a signal comprising musical information which is played by a sound output means. The images are retrieved from a storage device. The image portion converted into musical information corresponds to the location of a cursor displayed over the image. The central processing unit is programmed and controlled by a keyboard and mouse to move the cursor to varying positions on the displayed image and to generate different musical information depending on the color data at each position. The apparatus and method can also be used to transform audio input from a musical device and a MIDI interface into color data for display as an image on a color graphical output means.

73 Claims, 16 Drawing Sheets

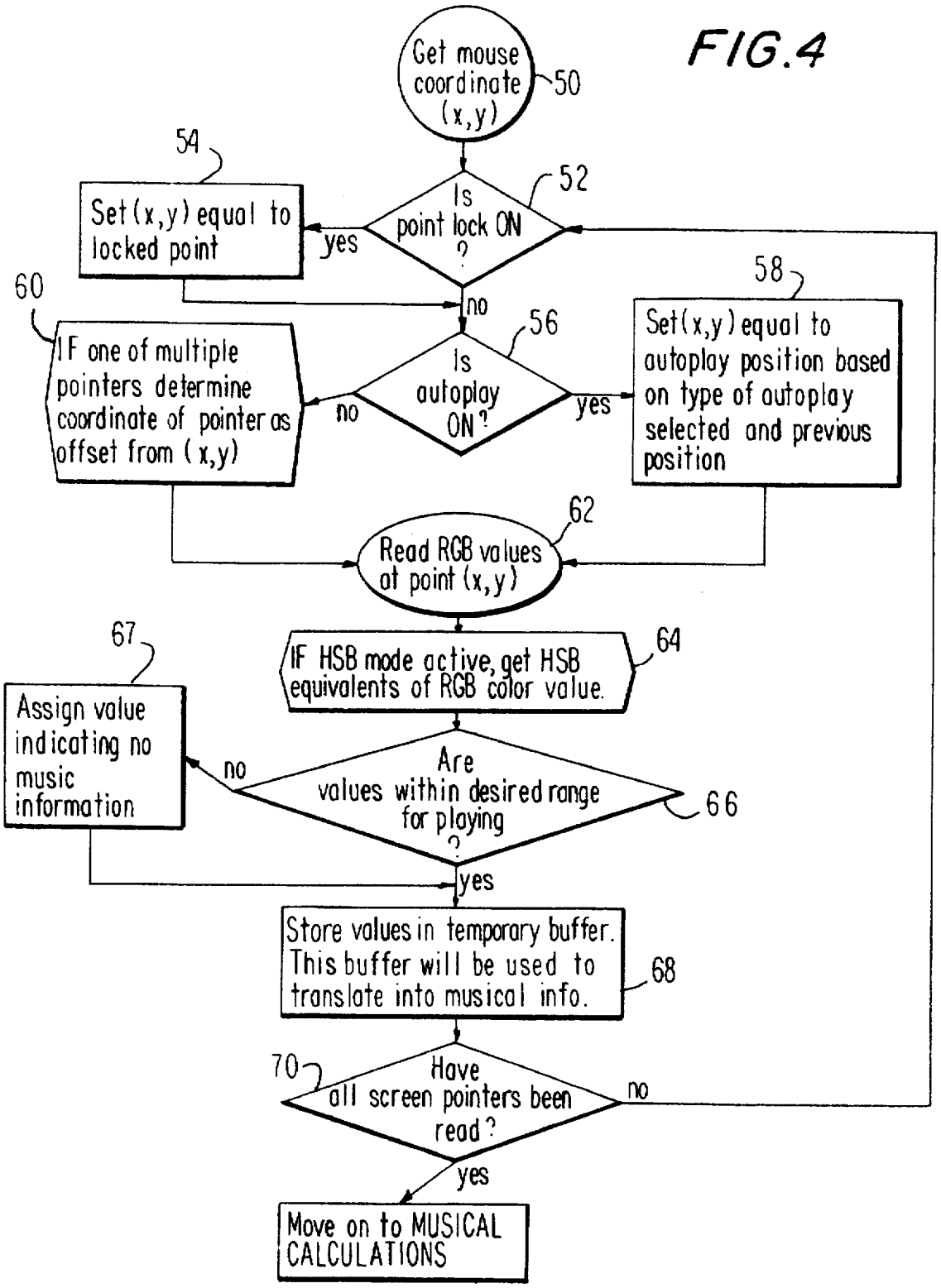
FIG.4
Get mouse coordinate (x,y)
50
Is point lock ON ?
52
yes
Set (x,y) equal to locked point
54
no
Is autoplay ON?
56
no
yes
IF one of multiple pointers determine coordinate of pointer as offset from (x,y)
60
Set(x,y) equal to autoplay position based on type of autoplay selected and previous position
58
Read RGB values at point (x,y)
62
IF HSB mode active, get HSB equivalents of RGB color value.
64
Are values within desired range for playing ?
66
no
Assign value indicating no music information
67
yes
Store values in temporary buffer. This buffer will be used to translate into musical info.
68
Have all screen pointers been read ?
70
no
yes
Move on to MUSICAL CALCULATIONS

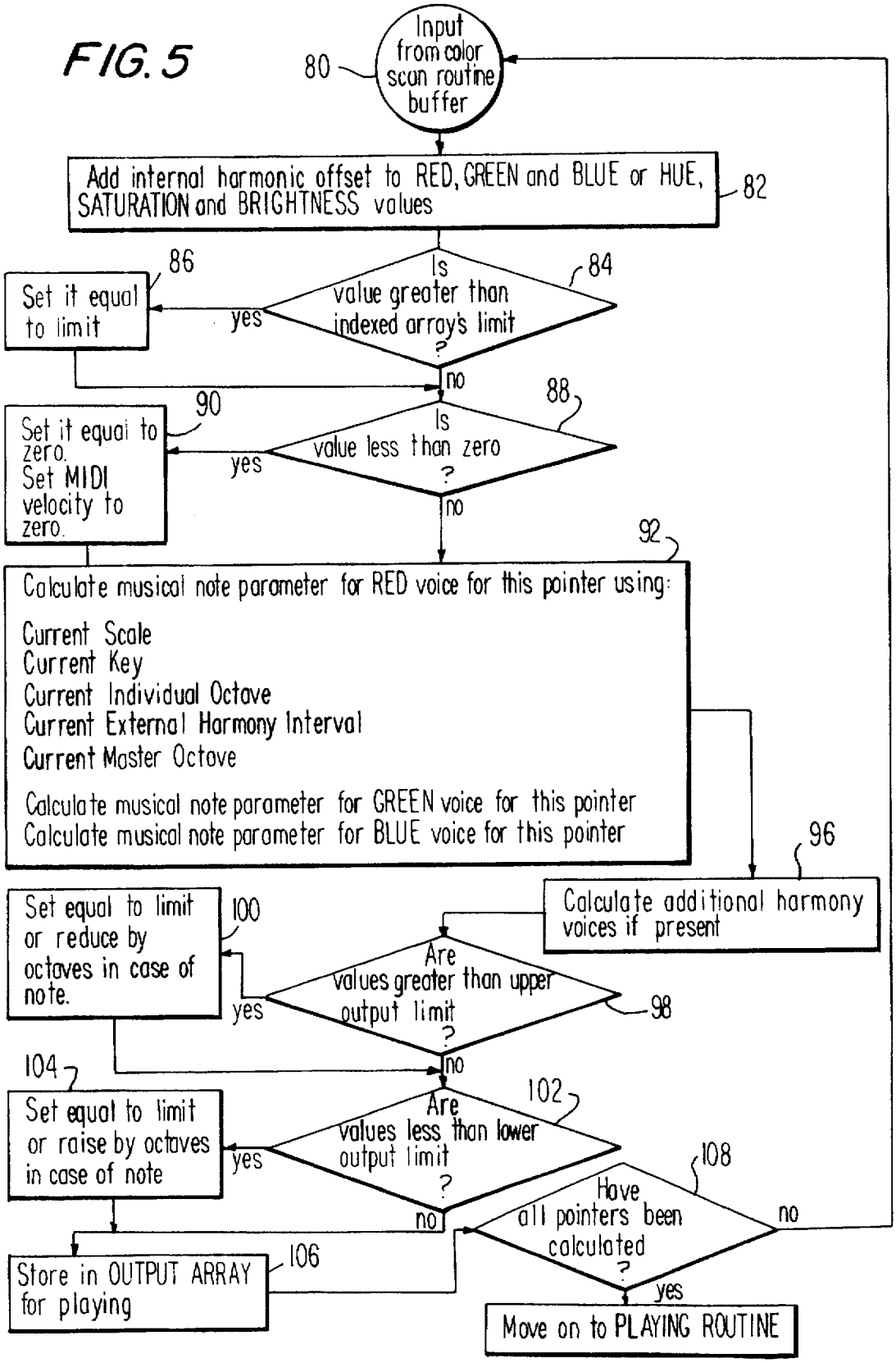
FIG. 5
80
Input from color scan routine buffer
Add internal harmonic offset to RED, GREEN and BLUE or HUE, SATURATION and BRIGHTNESS values
82
Is value greater than indexed array's limit ?
84
yes
86
Set it equal to limit
no
Is value less than zero ?
88
yes
90
Set it equal to zero. Set MIDI velocity to zero.
no
92
Calculate musical note parameter for RED voice for this pointer using:
Current Scale
Current Key
Current Individual Octave
Current External Harmony Interval
Current Master Octave
Calculate musical note parameter for GREEN voice for this pointer
Calculate musical note parameter for BLUE voice for this pointer
96
Calculate additional harmony voices if present
Are values greater than upper output limit ?
98
yes
100
Set equal to limit or reduce by octaves in case of note.
no
Are values less than lower output limit ?
102
yes
104
Set equal to limit or raise by octaves in case of note
no
Store in OUTPUT ARRAY for playing
106
Have all pointers been calculated ?
108
no
yes
Move on to PLAYING ROUTINE

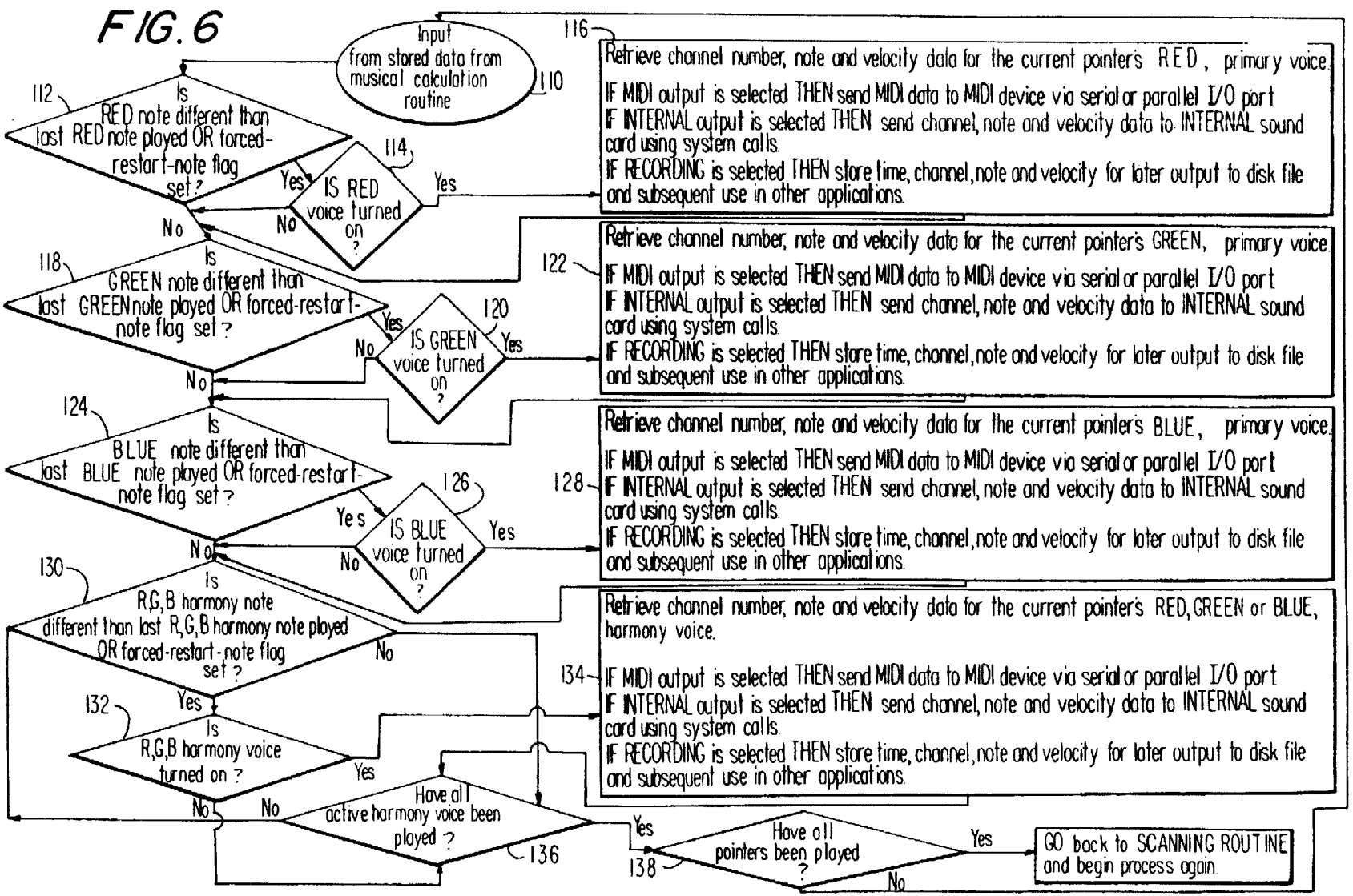
FIG. 6
Input from stored data from musical calculation routine
110
Retrieve channel number, note and velocity data for the current pointer's RED, primary voice
IF MIDI output is selected THEN send MIDI data to MIDI device via serial or parallel I/O port
IF INTERNAL output is selected THEN send channel, note and velocity data to INTERNAL sound card using system calls.
IF RECORDING is selected THEN store time, channel, note and velocity for later output to disk file and subsequent use in other applications.
116
Is RED note different than last RED note played OR forced-restart-note flag set ?
112
Yes
No
IS RED voice turned on ?
114
Yes
No
Retrieve channel number, note and velocity data for the current pointer's GREEN, primary voice
IF MIDI output is selected THEN send MIDI data to MIDI device via serial or parallel I/O port
IF INTERNAL output is selected THEN send channel, note and velocity data to INTERNAL sound card using system calls.
IF RECORDING is selected THEN store time, channel, note and velocity for later output to disk file and subsequent use in other applications.
122
Is GREEN note different than last GREEN note played OR forced-restart-note flag set ?
118
Yes
No
IS GREEN voice turned on ?
120
Yes
No
Retrieve channel number, note and velocity data for the current pointer's BLUE, primary voice
IF MIDI output is selected THEN send MIDI data to MIDI device via serial or parallel I/O port
IF INTERNAL output is selected THEN send channel, note and velocity data to INTERNAL sound card using system calls.
IF RECORDING is selected THEN store time, channel, note and velocity for later output to disk file and subsequent use in other applications.
128
Is BLUE note different than last BLUE note played OR forced-restart-note flag set ?
124
Yes
No
IS BLUE voice turned on ?
126
Yes
No
Retrieve channel number, note and velocity data for the current pointer's RED, GREEN or BLUE, harmony voice.
IF MIDI output is selected THEN send MIDI data to MIDI device via serial or parallel I/O port
IF INTERNAL output is selected THEN send channel, note and velocity data to INTERNAL sound card using system calls.
IF RECORDING is selected THEN store time, channel, note and velocity for later output to disk file and subsequent use in other applications.
134
Is R,G,B harmony note different than last R,G,B harmony note played OR forced-restart-note flag set ?
130
Yes
No
Is R,G,B harmony voice turned on ?
132
Yes
No
Have all active harmony voice been played ?
136
Yes
No
Have all pointers been played ?
138
Yes
No
GO back to SCANNING ROUTINE and begin process again

PAINT PALETTE

MUSIC GENERATING SYSTEM AND METHOD UTILIZING CONTROL OF MUSIC BASED UPON DISPLAYED COLOR

FIELD OF THE INVENTION

The present invention relates generally to the generation of sound from input data and more particularly to a system and method for generating music from color information.

BACKGROUND OF THE INVENTION

Computers have been used, in various forms, to interact with and/or mimic musical instruments since the late 1970's. In the early 1980's, the widespread availability of personal computers brought the opportunity to play and create music using computers to the amateur musician.

One of the earliest programs developed to facilitate the generation of music with a computer was called "Music Mouse" by Laurie Spiegle. This program permitted the user to play "virtual" piano keyboards by moving a mouse pointer across the "keys". A subsequent, more advanced program called "M", by Joel Chadabe, allowed the user to set "sliders", "numbers" and "buttons" to affect, in real time, a piece of prerecorded music. This tended to result in music which was repetitive and stylistically uniform. Other attempts to generate music with a computer have involved variations on these themes—i.e., "clicking" or "dragging" buttons, gadgets and keyboards to affect musical parameters and notes.

In 1988, the present inventors developed a rudimentary program called "PIXOUND" which played musical notes in response to colors appearing on a Pixound screen. Using a predefined color graphic image or one created using a paint program, a set of three tones (voices) was played, for each distinct pixel or group of pixels (as preselected) which was passed over by a single pointer.

Upon activation, Pixound would create an indexed array of variables (i.e., a look-up table) to store RGB values associated with the 16–32 colors available for display on the screen. These values were then used to directly index a musical scale. An output buffer was created for three voices and setup values for the specific Musical Instrument Digital Interface ("MIDI") voices to be used on the selected MIDI channels were loaded.

When the pointer passed over a particular point (pixel) to be "played", the x-y coordinates of that point were used to determine which index number of color was being pointed to (a number from 0 to 31, inclusive, was assigned to each point on the screen). That index number was then used to look up the pre-determined RGB value (range 0–15) in the table.

The RGB values were: (a) directly mapped into an indexed array of a pre-selected 15 note musical scale; and (b) added together to determine the brightness of the color—that was then translated into a velocity value (velocity is analogous to how hard a piano key is struck). If harmonies were desired, the green and/or blue values were modified to produce harmonic offsets rather than remaining true to the value derived in the table.

The three notes determined through this process were then transposed to the pre-selected key and a signal corresponding to this information was sent to sound means for play.

Various options and features were available to alter the sounds generated by any given color. They included: patches (pre-defined sounds for each of the three voices—e.g., instrument samples); pitch; harmony; scales; rhythm; velocity; and sensitivity.

However, this first system had a number of significant drawbacks. For example, the musical play was limited to items displayed in the Pixound window. In a Windows® or Macintosh® environment, this is unduly limiting. The processing of sound was grossly unsophisticated because of the tying of velocity to brightness (i.e., all dark colors were played softly), the use of a look-up table to translate the color data and reliance on a single pointer to obtain the color data. Because of the abbreviated color range, the small number of available voices, and the awkward method of harmonization, the musical result of Pixound was limited as well as unsophisticated. The inflexibility of the system as well as the other drawbacks made the system difficult to master and rendered the system unsuitable for serious music production.

SUMMARY OF THE INVENTION

It is thus an object of the present invention to provide an improved flexible, user controllable system and method for generating music from color data.

It is another object of the present invention to provide a wider array of voices than has been previously possible, tied to a greater number of color selection points.

It is a further object of the present invention to improve the correlation of music to color to generate more sophisticated music over a wider musically expressive range.

It is yet another object of the present invention to provide the ability, to process on the fly, millions of colors to be read and used as a basis for generating music.

It is a still further object of the present invention to provide a system and method which generates music from color data in which velocity is not tied to color brightness.

The present invention is directed to a system for generating music from input data preferably comprising a central processing unit ("CPU"), an input device connected to the CPU, color graphical output means, for displaying information corresponding to data input via the input device, data and program storage means, sound output means, and conversion means interacting with the CPU for converting selected color graphical data, displayed on said color graphical output means, into sound, output by the sound output means. It is also directed to a method for making music comprising providing a preprogrammed computer with data storage and retrieval equipment and at least one input device, generating signals sufficient to cause the display of a color image on a display, creating a record of the color value of each addressable point capable of being mapped onto a display, selecting at least one of the addressable points, reading the color value of the selected point, converting the read out color value of the selected point to at least one musical parameter value, and sending a signal corresponding to the musical parameter value, to sound output means capable of rendering the value as audible sound.

Through use of the present invention, sophisticated music appropriately matched to a visual work can be easily created by a novice. The use of color in the present invention achieves this end by removing the need to be able to play an instrument or read music to score a movie or create a multimedia presentation.

As such, the present invention offers significant advantages over the prior art. In particular, it provides advantages over applicants' prior invention, Pixound, in that the present invention provides: the ability to encode entire musical works into broad-range color chords as opposed to 32 narrow range chords; full broad-band access to the entire audible range of notes; a ten-fold increase in polyphonic power (three note to thirty note); the ability to play videos (e.g., motion pictures and animation); the ability to compose music using color; the ability to play sophisticated chord progressions; the ability to use the Hue, Saturation and Brightness color model and improved and expanded methods for creating harmonies while maintaining the integrity of Green and Blue color values.

BRIEF DESCRIPTION DRAWINGS

In the drawings:

FIGS. 2–6 are flow chart diagrams illustrating various features of the present invention.

DETAILED DESCRIPTION

Overview of the System and Method

Figure 1:
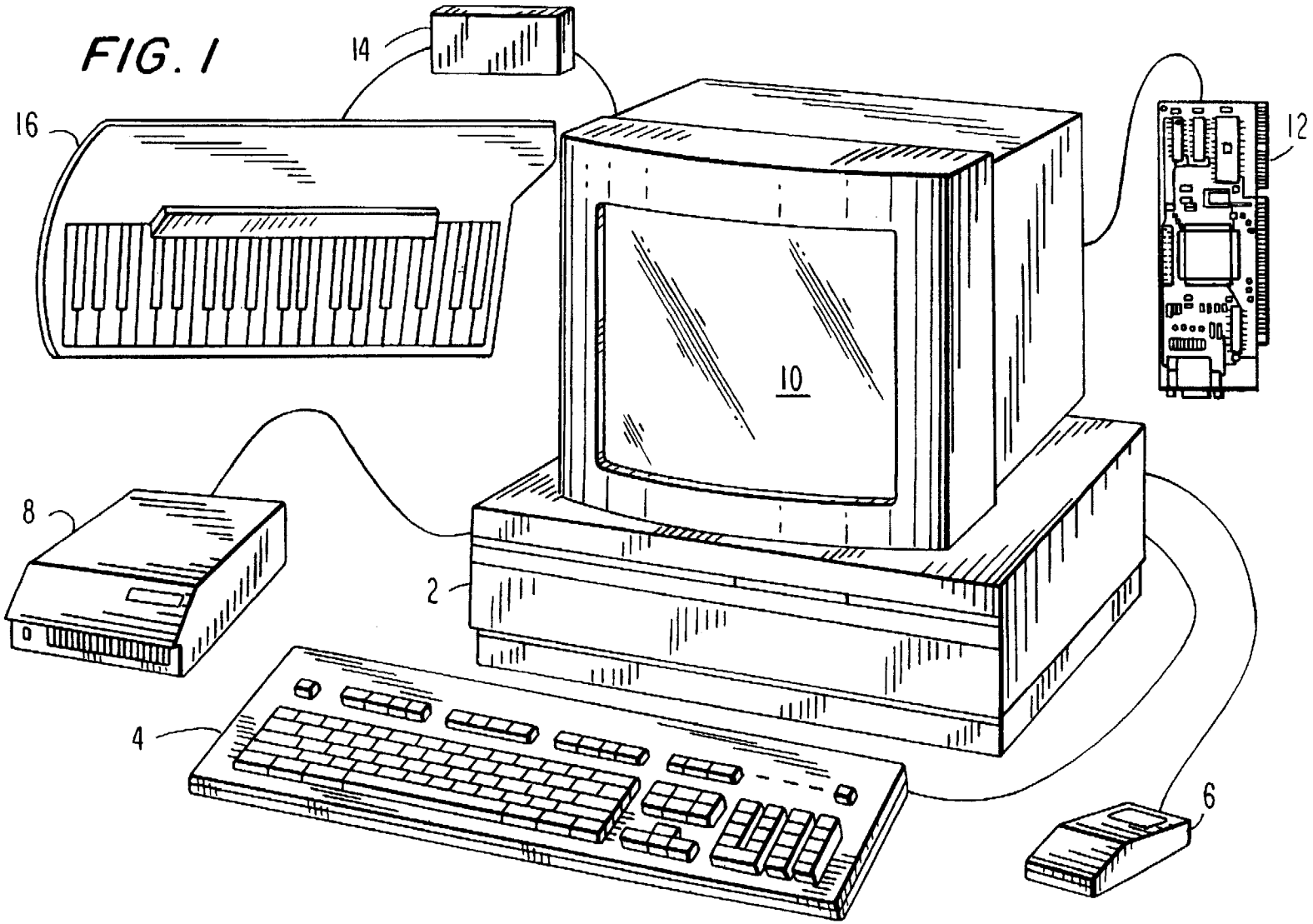
FIG. 1 is a schematic diagram of the overall hardware configuration of the present invention.

Referring to FIG. 1, the system hardware of the present invention preferably comprises a central processing unit 2, a keyboard 4, a mouse 6 (or other pointing device (not shown)), a storage device 8 (e.g., a "hard disk"), a color display 10 and sound output means 12. Optional equipment includes a MIDI interface 14 and a MIDI synthesizer 16.

In order to generate music from color data, a source of color data must be chosen. Color images, stills or videos, may be retrieved from the storage device 8 or received from an external source (e.g., via modem or network interface card) and displayed on the color display 10. This display is made up of a plurality of individual addressable points (generally referred to as pixels), each with a discrete color value. These values are stored in a "screen buffer".

Each color value is comprised of three components. In the so-called RGB system, the components are 'R'ed, 'G'reen and 'B'lue, each typically assigned a value from 0–255. In an HSB system, the components are 'H'ue, 'S'aturation and 'B'rightness each typically assigned a value from 0–240. Other systems are known which may also be employed.

One or more pointers are also preferably visible on the color display 10 and visually demonstrate the selection of individual addressable points—each point corresponding to a particular color value as described above. The pointer(s) may be directly controlled by the keyboard 4 or the mouse 6, or any other input device. Alternatively, the pointer(s) may be moved automatically either in accordance with a predetermined pattern or randomly. These features are described in greater detail below.

Each value read out from the screen buffer, in accordance with timing set via a sensitivity control, is translated, by conversion means, into signals which are used by sound means to play "notes". The specific notes which will be played and the manner and timing of their play are affected by a number of user selectable controls including: tolerance; velocity; instruments/voices; harmony; number of pointers; scales; key; pitch bend; panning; rhythmic pulses and accents; volume; mix; and special effects.

Specific Features

Sensitivity

The actual reading out of color values is governed by a user selectable "sensitivity" control. Sensitivity is a measure of how often the color value is sampled at the location of the pointer(s). In other words, it is the equivalent of a timer which determines how many times per minute the color value is read, regardless of the location of the pointer(s). For example, if the sensitivity is set to 100%, the color value will be sampled as often as the CPU will allow.

Tolerance

The selection of a particular tolerance level sets the parameters for the answer to the logical question, "Is the pointer positioned on a new color?" Depending upon the tolerance level chosen, this may not be a simple "yes" or "no" question. Rather, it depends upon whether the tolerance is set so that any color change is significant. In other words, the tolerance setting determines how significant a color change must be to cause the passing of the color value to the conversion means to generate the playing of at least one "note". If the tolerance is set to 0, any color change at the pointer(s) position, no matter how slight, will result in the playing of a note.

Velocity Controls

The setting of the velocity level determines how notes are "struck", i.e., analogous to how hard a piano key is struck. Rather than being simply a volume control, velocity is the measure of the attack of a note. This is sometimes called dynamics. In the MIDI specification (a standard for the transmission of musical performance and other data to control compatible electronic instruments), velocity ranges from 0–127 where 0 is off and 127 is maximum effect. Velocity is often used to alter the envelope of a given sound, but is more frequently associated with soft or loud (as in pianissimo (pp) or fortissimo(ff)). In the present invention velocity is used to create various dynamic and rhythmic effects.

Voices and Instrument Selection

Voices are typically equated with instruments but need not be confined to any recognizable instrument. For example, a voice can be a pig snort or a sound effect such as a slap. However, for the generation of what is normally considered "music" and for purposes of this description, ordinary instruments like pianos and violins are preferable. The instruments/voices are themselves dependent upon on several things: the internal sound board; the attached MIDI device (if any); the number of pointers; patches; harmonies; octaves; and harmonic offsets.

Voices are represented, at least indirectly, by the pointers. The present invention preferably provides up to five pointers with each pointer representing at least one and up to six voices. With the use of harmonies and patches, five pointers can yield up to 30 voices. This is more voices than a typical orchestra. Yet, the present invention could be configured to provide even more than 30 voices. However, such a configuration is likely to result in cacophony without additional music controls to integrate the additional musical information and, as such, is generally not desirable.

Pointers

Figure 7:
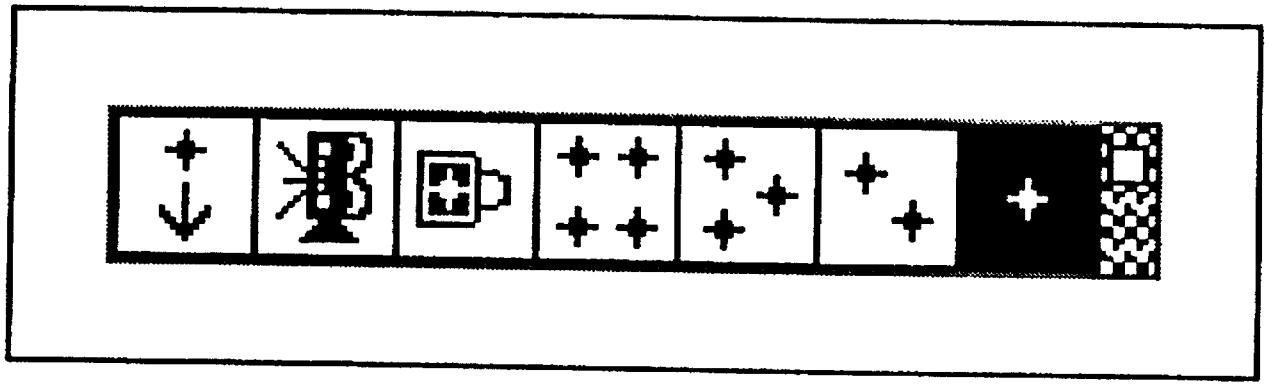
FIG. 7 is a schematic representation of a pointer palette.

As noted above, up to five pointers are available for selecting color data input from the screen with each pointer beyond the first one derived as an offset from the actual position of the cursor (or main pointer). Preferably a pointer palette, as shown in FIG. 7, is provided to facilitate this selection.

Four main pointers and one duet pointer, which follows the main pointer exactly (i.e., with no offsets), are preferably provided by the present invention. These pointers are either anchored to user selected fixed locations on the screen for situations where the background is changing (e.g., for a video) or substantially fixed relative to each other to allow a single input device to control the movement of all the pointers, at the same time, over the entire screen. This group of pointers and their chosen configuration are referred to as a "stylus", to convey the same notion as that provided when the term is used for phonograph needle.

Figure 8:
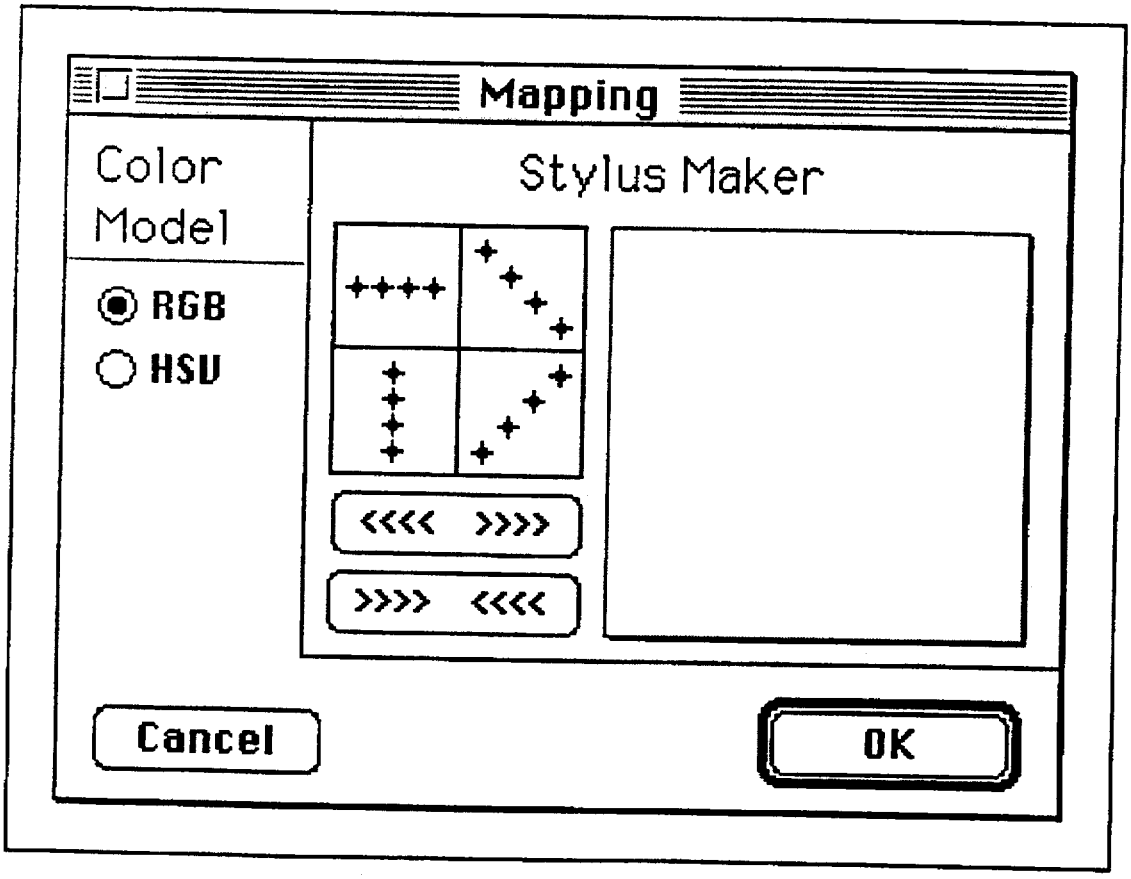
FIG. 8 is a schematic representation of a mapping palette.

The arrangement of the pointers (or configuration of the stylus) can be even further refined by selection of preset patterns or construction of user defined patterns available through a Mapping Palette, shown below in FIG. 8.

Each pointer has three primary voices and an optional three harmony voices. This yields up to 30 voices. The three primary voices are based on reading three values at each point—one for each RGB component color. If a particular component color is turned off, then the number of values read is diminished and consequently the number of possible voices diminished.

The Orchestrator

Figure 9:
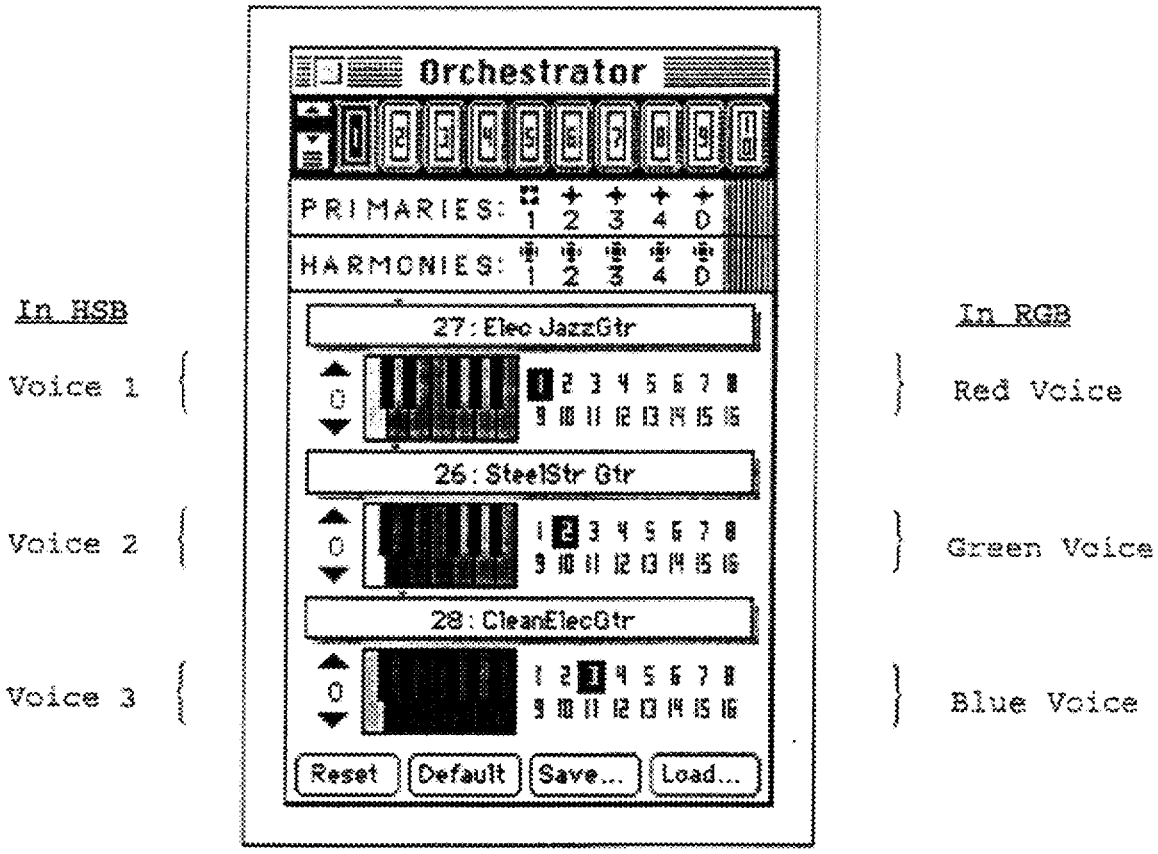
FIG. 9 is a schematic representation of an orchestrator to select and control the voices.

Preferably, an "Orchestrator" or the like, as shown below in FIG. 9, is provided to select and control the voices.

Patches

The top section of one embodiment of the orchestrator offers 10 patches (presets) which automatically switch all voices to those which are preset on the selected patch. Since each patch can potentially effect 30 separate voices thereby changing the instruments, harmonic offsets, MIDI channels and octave settings for each, the creation and storage of preferred settings is desirable. This can be done via preprogrammed default settings, by direct user input or by modification of the default settings by the user.

Pointers

The next section of one embodiment of the Orchestrator is a pointer selector. This is used to select the particular pointer which will be effected by modifications undertaken via the Orchestrator.

Harmonies

The third section is for selection of the particular harmony voice which will be effected by modifications undertaken via the Orchestrator. In the RGB model, three harmony voices can be added for each selected primary pointer. The selection of harmony voices does not result in the display of additional pointers. Rather, harmonies are tied to the primary pointers and are simply offsets which are set via the final section of a preferred embodiment of the Orchestrator.

Instruments

The final section of the Orchestrator is divided into three duplicate sections. These three sections represent the division of each pointer into three voices. In the RGB model the voices are the Red Voice, the Green Voice and the Blue voice. In the HSB model they represent Voice 1, Voice 2 and Voice 3. (When the HSB model is employed the three voices play the same note since they represent a single Hue since the Hue is not divided into three components. The Saturation and Brightness components are indeed read at each pointer but are used to affect other music parameters, as explained in more detail below.)

The final section of the Orchestrator preferably displays the preselected instruments which correspond to the currently chosen patch. These instruments can be varied by the user to any "instrument" otherwise available, thus discarding the preset position. Factors which influence the selection of instruments other than those which are preset include the number of instruments which are made available by the sound card and/or a MIDI device.

Actual selection of instruments is accomplished via a "virtual slider". The slider instantly moves to the position of the selected instrument thus providing ready access to adjacent (i.e., similar instruments).

The Orchestrator also can be used to select the MIDI channel which will actually play the instrument. This is particularly important when multiple MIDI devices are connected to the CPU. In such cases, the channels can be selected to address specific devices.

A virtual piano key octave is also provided in the last section of the Orchestrator. This octave is used to select and show note/scaler offsets for the play of any selected harmonies. An octave offset, representing octave deviation above and below the note to be played by the primary pointer is a further part of this section.

Harmony offsets set via the virtual piano key octave (other than direct octave offsets) can be fixed, i.e., x notes up in the full range (absolute) scale, modal, i.e., x notes up within a particular scale, or algorithmic, i.e., modal but varying the number of notes within the particular scale. The selection of these types of offsets can be set via other menus, described below.

Scales

Figure 10:
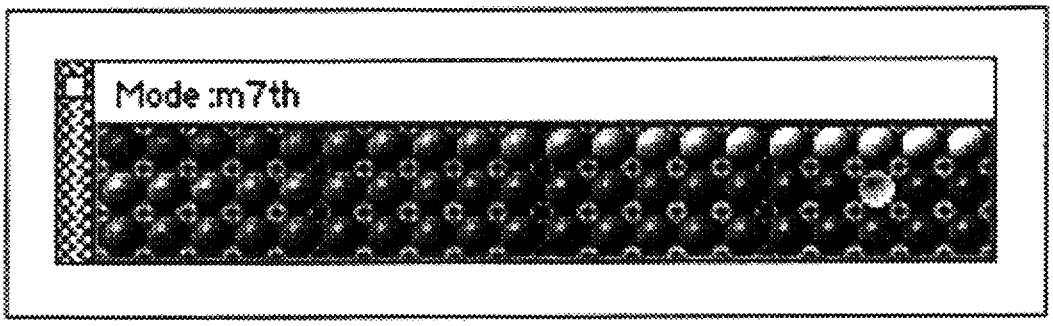
FIG. 10 is a schematic representation of the mode grid for selecting the desired musical scale to influence the musical play.

A "Mode Grid", as shown below in FIG. 10, is also preferably provided for selecting the desired musical scale to influence the musical play. These scales can be chromatic, full range, pentatonic, microtonal, Octave Dorian, etc. Scales can also be custom defined as notes of cords, e.g., an arpeggio, or any other plurality of notes or microtones. The selection of the musical scale primarily effects the composition of the group of notes which the color values will address. This selection can also be assigned separately to each pointer, though care must be taken to avoid unwanted cacophony. For example if a scale based on an arpeggio is selected, only those notes associated with that arpeggio will be played. The mode selected can have a drastic influence over the mood of the music causing it to go from joyous to dark.

The present invention preferably provides more than 60 different musical scales. The scale data is placed into an indexed array where the indices are: 1) the scale number (e.g., 1–60); and 2) the note number within that scale (e.g., 0–127). This data is directly indexed using the color data to permit precise control over the tonality of the music played.

The scale number index can be switched at any time causing an immediate change in the musical mood. This is especially important for precise timing of chord changes while in Song Mode or while performing. It should be understood that the method of scale representation is preferably such that absolute frequencies are available for microtonal and ethnic tunings, melodic data for more melody-oriented playback, or traditional scales from western music covering the full musical range. Lastly, the length of the scale is not limited to 128 notes (while 128 notes is adequate for most western scales, microtonal, melodic and hybrid scales can require hundred of notes to complete the scale or melody), nor is the number of available scales limited to 60.

Rhythmic Accents

Figure 11:
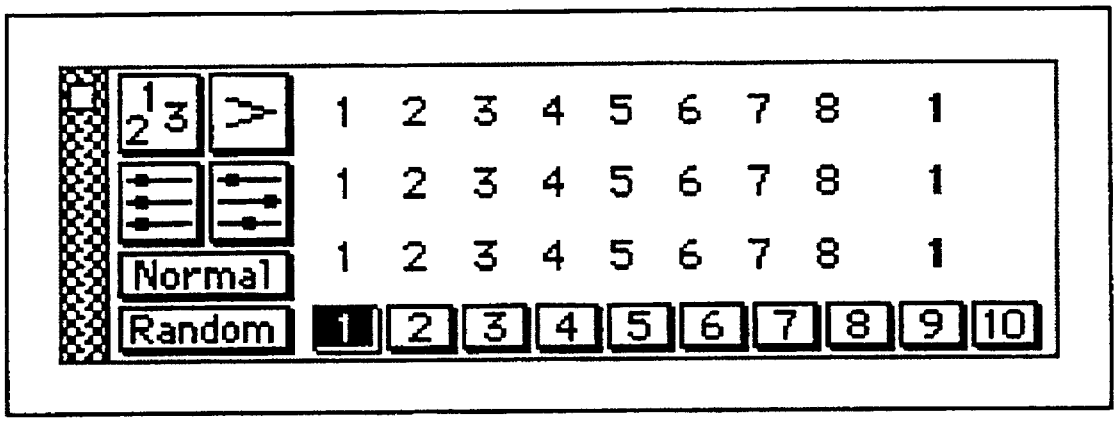
FIG. 11 is a schematic representation of a rhythmic accents palette.

The pulse of the music play can be affected by the selection of rhythmic accents. Through a Rhythmic Accents Palette, shown below in FIG. 11, off beat velocities, emphasis points, and accent notes can be selected. For example, it is possible to select the equivalent of triplet time causing emphasis on every third full note.

Rhythms are sequential modifications of sensitivity. If the rhythm setting is engaged (turned on), a note will not play until a certain time has passed in accordance with the chosen rhythm. This time value changes over time create a rhythmic effect such as "Samba" or "Waltz". Tempo, as opposed to rhythm, is directly varied by the sensitivity setting and is simply the speed with which the color samples are taken and corresponding notes are played. Thus, a chosen rhythm will "overlay" the sensitivity such that increasing or decreasing the sensitivity will result in faster or slower "play" of a chosen rhythm.

In other words, different rhythms are created by changing the delay time of note play to different values in proportion to the current sensitivity setting. As such, the rhythm pattern increases in speed in proportion to increases in sensitivity.

Key

The present invention permits the user to select any key for music play. The particular key can be set via keyboard selection or though an external MIDI device.

Volume, Pitch Bend, Panning and Special Effects

Volume, pitch bend, panning and special effects are all available and user selectable through menu and/or keyboard selections. These controls can be set to affect the music in a completely flexible manner subject only to user imagination.

Information Palette

Figure 12:
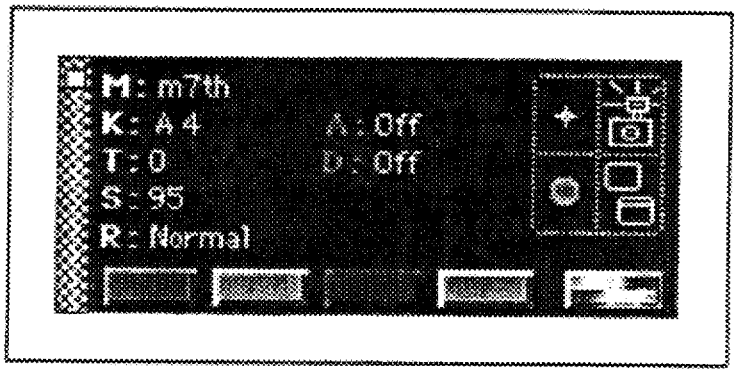
FIG. 12 is a schematic representation of an information palette which displays important musical information for user review.

A display of important musical information is preferably available for user review via an Information Palette as shown below in FIG. 12.

The mode, key, tolerance, sensitivity and rhythm settings are displayed as well as the status of autoplay and duet modes. Control over the visibility of the pointer(s), the status of the red, green and blue voices is also provided via this palette. A "snapshot" of all current graphics and musical parameters can be taken and stored on a disk.

Autoplay

As noted above, music can be generated either by direct user control of the pointers over the screen or by automatic movement over the entire screen or portions thereof, in accordance with a "pattern."

Examples of preferred patterns include:

Scan—the user selects an area of the screen with the mouse, and the pointer(s) scan "line-by-line", within the selected area, from left to right, without playing on the back stroke;

Random—the user selects an area of the screen in the same manner as with Scan, but within the constrained area, the pointer(s) move successively, randomly, x and y pixels away from previous point;

Pattern—a pattern of cursor movement is recorded. Then, that pattern is followed by the pointer(s). Individual pattern points can be set rather than a continuous play range;

Circular—an x and y radius are specified to create a circular or elliptical orbit around the cursor. As the cursor is moved around, the pointers automatically orbit the cursor.

Zig Zag—the pointer(s) plays horizontally in both directions, moving down vertically a selected pixel distance 'y' with each separate horizontal movement Scrolling—moves bands of color at a set speed, from within a selected area, past the pointer(s), which plays the colors as the colors "scroll" past.

Each type of autoplay offers two user definable parameters; range and speed. The range setting determines how many pixels are spanned between each read at the pointer location(s). For example, if the range is set to 1, every single pixel is played, both horizontally and vertically, in accordance with the selected pattern. If the range is set to 7, every 7th pixel is read and played. (In general, the higher the autoplay range, the faster it moves around the screen.) In the Pattern mode, if there are 10 points, and the range is set to 3, then points 0, 3, 6, 9, 2, 5, etc. are played.

The speed setting is akin to the sensitivity setting and simply determines how fast the pointer(s) move over pixels.

Automatic Musical Color Encoding

The present invention also permits the generation of color from music. For example, music data from a song, can be read and a color image of that song generated. The color image will consist of bands of color corresponding to the note and duration of the note's play. Depending upon the input mode chosen, the image can be laid down on the screen linearly, circularly, random or in accordance with any other normal autoplay pattern. These color bands can laid down in tracks to create a multi track encoding where each pointer can read its own track.

From the color display on the screen, the same input music can be replayed or varied by rhythm, speed, key, scale, harmony, instruments and even note order. Standard autoplay patterns can even be run over the new image to "automatically" create new versions of pre-recorded music.

Song Mode (Automatic Chord Progression)

Figure 13:
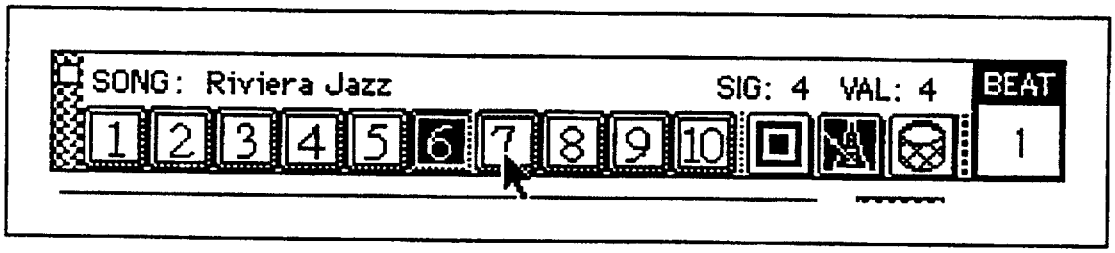
FIG. 13 is a schematic representation of a song mode palette to select a particular song to serve as a template for play of a given image.
Figure 14:
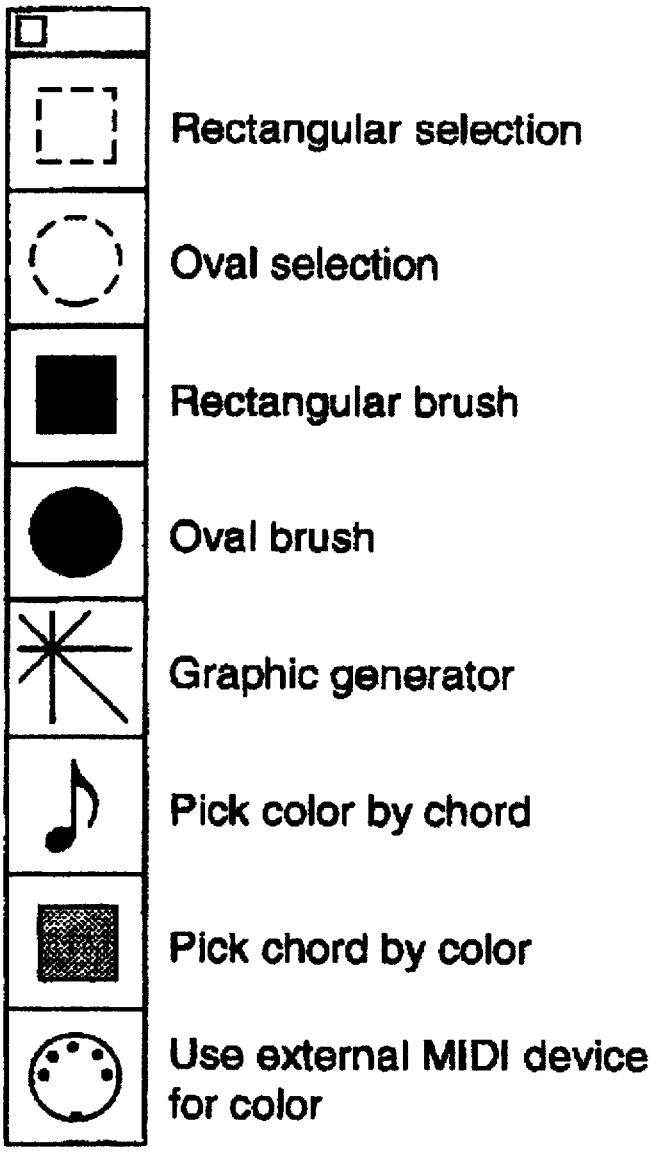
FIG. 14 is a schematic representation of a music paint palette.

Closely related to Automatic Music Encoding but also incorporating elements of scale, key and rhythm selection is the Song Mode. Preferably using a Song Mode Palette, as shown below in FIG. 13, a user can select a particular song to serve as a template for play of a given image. In other words, the notes, scales, key and rhythms of the chosen song are used to define the parameters for play of an image. This presents brand new opportunities to recast pleasing songs to new images.

Music Painting

Another variation of Music Color Encoding is music painting. A Music Paint Palette, as shown in Table VIII, is preferably provided as part of the present invention. This feature permits a user to "paint" in color, using music parameters. For example choosing the rectangular or oval paint mode icons (corresponding to such icons in standard paint programs), will use the last selected chord as a fill color or pattern to fill-in the rectangle or oval. Choosing the note icon permits the direct selection of notes or chords to be used as the fill color. The star icon permits the painting of octaves of the selected chord. A musical "spray paint" can also be achieved by a combination of key strokes or by menu selection in any mode. The "paint" will spray in the last selected chord's color pattern. The MIDI paint icon, when selected, allows direct input from a MIDI device such as a keyboard or a guitar to change the paint color so that all newly created images can reflect notes being played in real time, by a musician. Finally, three methods of color selection are also preferably provided: 1) Full Color Palette—musical notes are visibly displayed and audibly expressed; 2) Standard Color Picker— for entering exact RGB or HSB values to obtain precise colors; and 3) Musical Color Picker—for adjusting exact note values on a Full Range scale to get a resulting color.

Mixer

Figure 15:
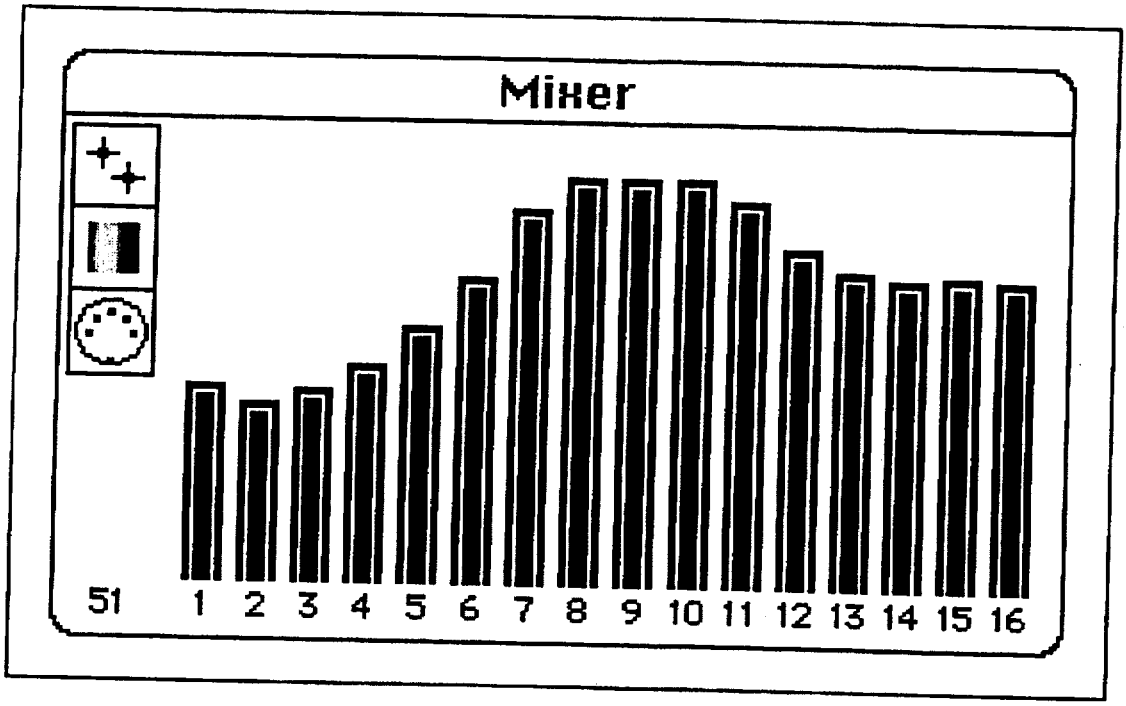
FIG. 15 is a schematic representation of a mixer control palette to permit the user to adjust the MIDI volumes associated within the selected voices.

A Mixer Control Palette is also preferably provided to permit the user to adjust the MIDI volumes associated with the selected voices. The Mixer Control Palette, as shown in Table FIG. 15 below, has three modes, pointer, color and MIDI channel. Depending upon the mode selected, the volume of the particular MIDI voice is adjustable up or down. For example, if the pointer mode is chosen, the current volume level for each pointer and its corresponding harmony is displayed and can be adjusted up and down.

Drum Beats

An independent drum track, generally not associated with color, can be played along with the pointer generated music. There is always one default drum pattern (song) in the background which defines the drum track and is tied to the chosen rhythmic accent. As such, when music is generated, a corresponding drum sound can be heard, if selected, along with the notes.

If desired, the drum track can be tied color. This can be achieved by assigning drum voices to Red Green or Blue instruments and creating a regular, repeating automatic pattern. This is most effective for "ethnic" drums such as congas or tablas.

Figure 16:
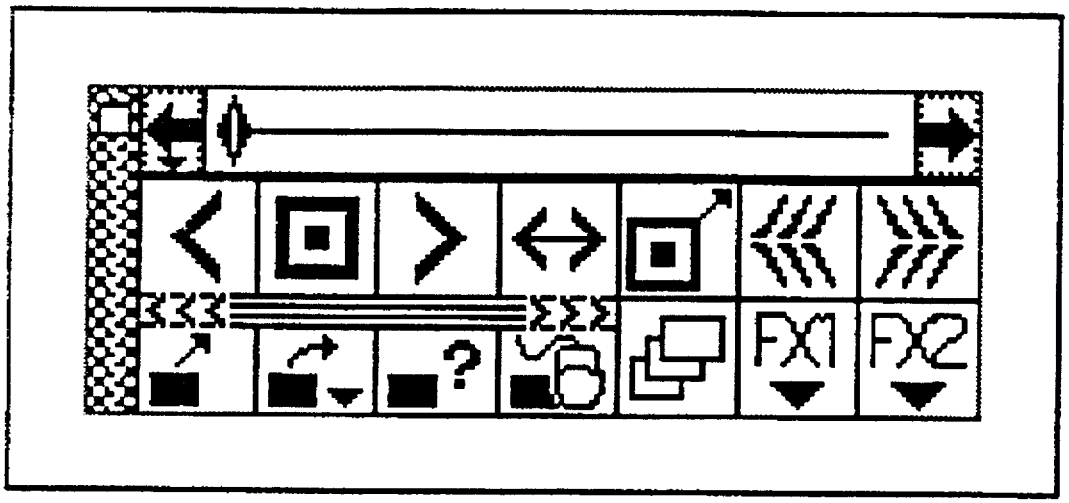
FIG. 16 is a schematic representation of a movie control palette which provides access to the various movie controls.

Drum speed is linked to sensitivity. This method achieves perfect synchronization Movie Controls A specialized set of movie or video controls are also provided with a preferred embodiment of the present invention. A Movie Controls Palette as shown below in FIG. 16 preferably provides access to the various movie controls.

A slider control across the top of the palette defaults to provide control over the display of the frames of a selected video. In other words, when the slider is at one end the beginning of the video is shown, when the slider is in the middle, the middle of the video is shown and when the slider is at the other end, the end of the video is shown. By accessing submenus via the arrow key at the left end of the slider control, the slider can also be used to control video display size, volume and frame display speed.

Other controls include frame reverse, stop, frame play, frame ping-pong (back and forth play), fast/slow frame play, movie screen movement (i.e., movement of entire window in which video is shown)—rectilinear, curvilinear, random and pointer follow, movie screen image trail and special effects.

Color Models

As previously described, the user can choose between at least two color models: HSB and RGB. In the RGB model each color of a given pixel is comprised of three elements, Red, Green and Blue. For example, a purple color may be defined as Red=90, Green=51 and Blue=153. In the HSB model (sometimes called the HLS model for 'Hue', 'L'ightness and 'S'aturation), that same purple color would be defined as Hue=26, Brightness=40 and Saturation=50.

When the RGB model is used, the Red, Green and Blue values are read at the main pointer location and each value is treated as distinct note to be played by the corresponding voice as appropriate. In the HSB model, the Hue value is the only value used to determine the note to be played by the three voices. It is scaled down and used to pick a note from the scale array (e.g., 0–127). As such, only one note is played, albeit by different voices corresponding to potentially different instruments. Saturation is broken into three levels, where the higher the Saturation value, the more voices are used to play the note (i.e., at the highest level, three voices play the note). The Brightness value is used to control the Velocity, such that 0 is off and 255 is maximum.

In other embodiments of the present invention, the effect of Hue, Saturation and Brightness values can be scrambled such that Hue effects velocity, Brightness determines the note, etc. Similarly, a user can modify the RGB model to cause one color to determine the note and the two other colors to control selected musical parameters to, in effect, create a new color model.

Use of the Present Invention

Figure 2:
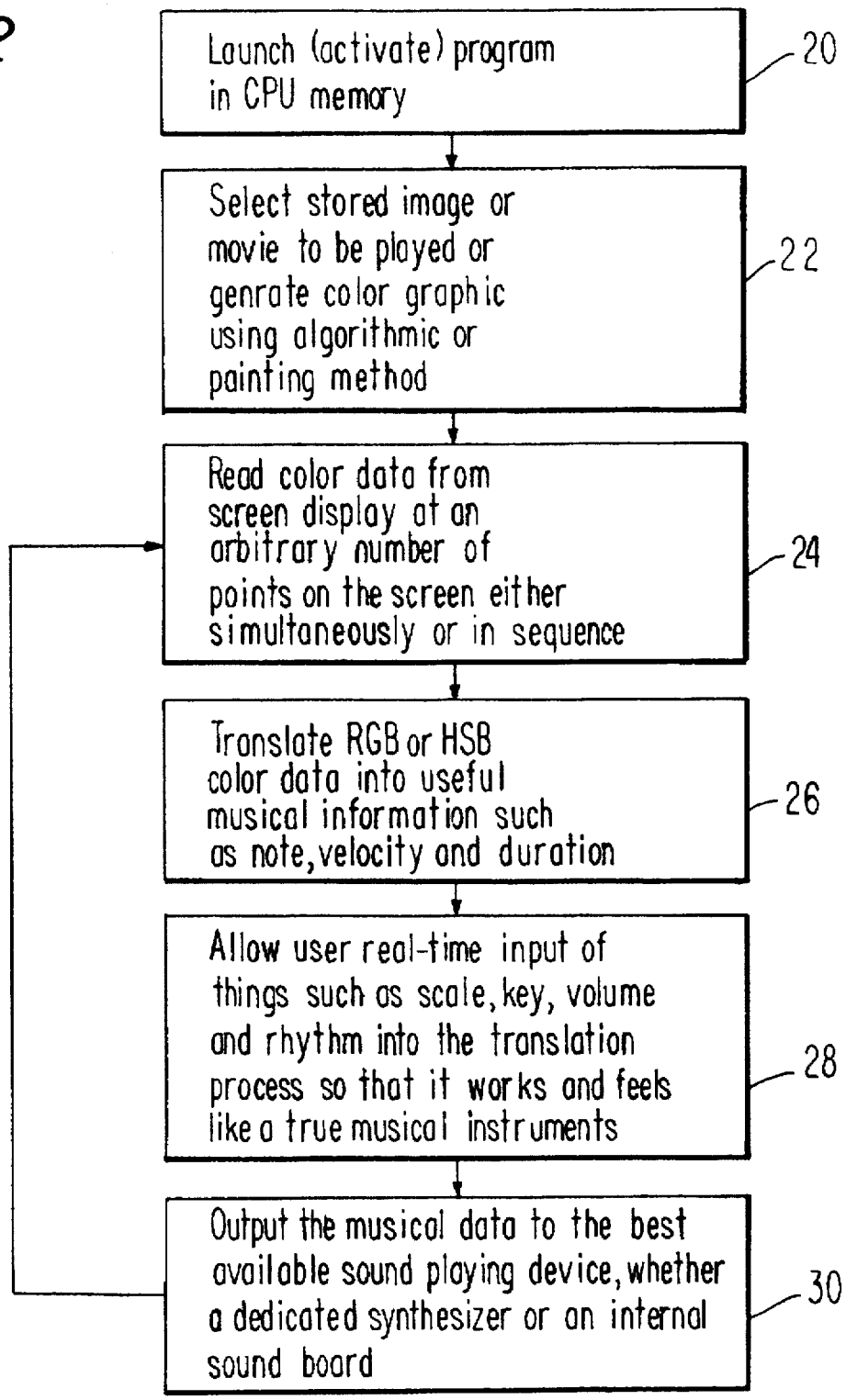

As shown in FIG. 2, in order to use the present invention, a user first launches the appropriate program 20 which is maintained in a storage location. This displays a screen which provides access to the various musical and graphic options described above via predefined keyboard combinations or by drop down menus accessible via the input device or the keyboard.

Next, an image or video may be selected to provide a source for generating music 22. Alternatively, an image can be generated by music painting or by musical encoding 22.

A cursor, in the form of one or more pointers is placed over the image or video and the color values are read 24. These values are then translated into useful musical information such as note and velocity 26.

At any time, in real time, the user can adjust the various musical and image play parameters so that the resulting music conforms with a desired mood or feeling as conveyed by an image or video 28. Alternatively, the user can simply explore unique combinations of parameters so that the system performs like a musical instrument 28.

Ultimately, the musical information is output to a sound playing device such as a synthesizer or sound board which plays one or more notes based on the original color data 30. The system then indefinitely repeats the music playing cycle as governed by the sensitivity and rhythm settings.

Screen Buffer

The present invention relies on the establishment of a screen buffer which contains information about the color value of each pixel which makes up the screen display.

Figure 3:
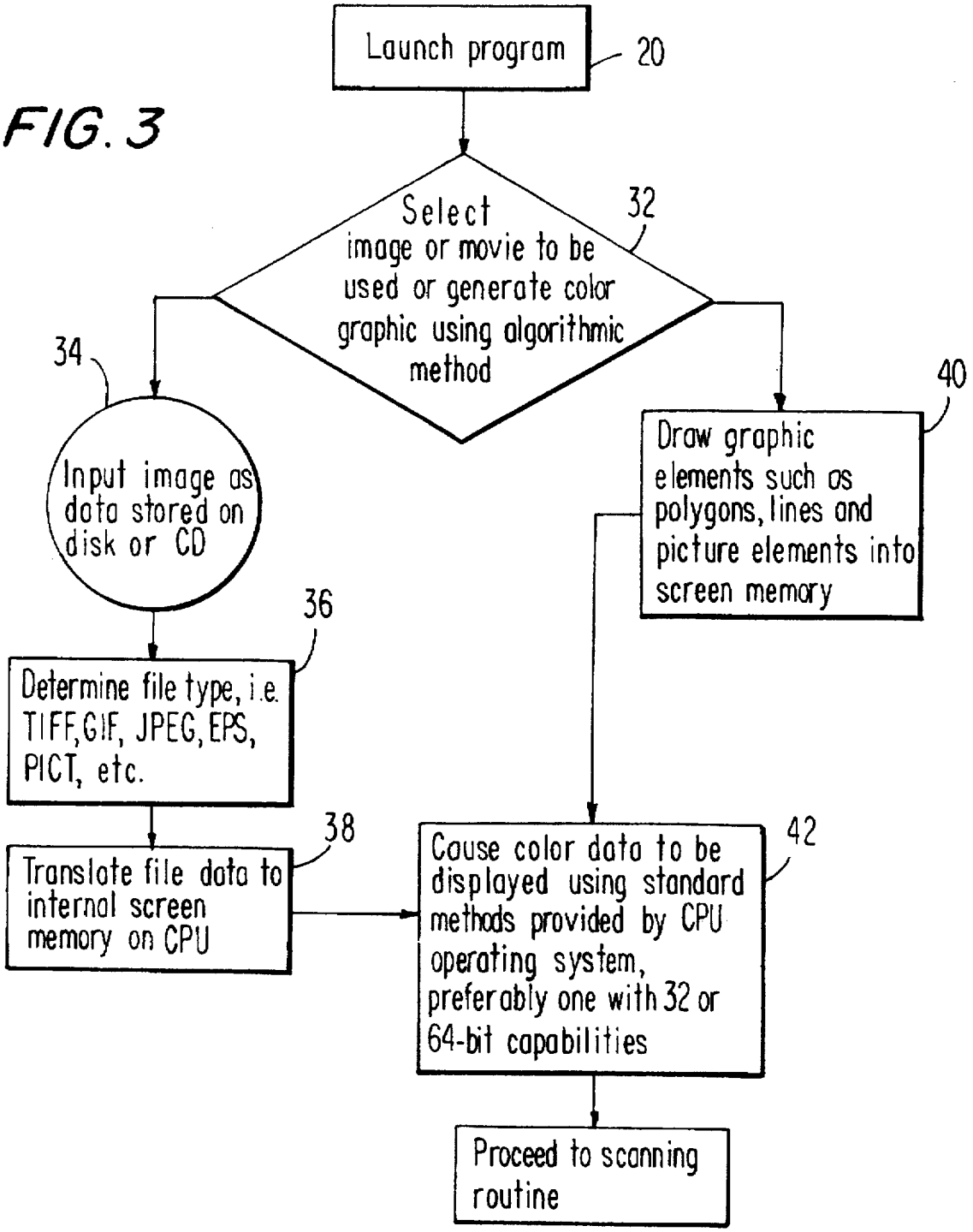

As shown in FIG. 3, after the program is launched 20, an image or movie is selected or generated 32. If a pre-existing image or video is chosen, the data comprising the image or video is read out from a disk or downloaded from an external source 34. The file type is determined 36 and the data is transferred to internal screen memory associated with the CPU 38.

Alternatively, the user can "draw" an image, the data for which is transferred into internal screen memory 40. The color of each pixel corresponding to the data is then displayed on a monitor to make up the image using conventional methods associated with the particular CPU operating system 42. Preferably, this system is at least a 32-bit system to provide sufficient response characteristics.

Color Scanning

Once an image or video has been displayed, the user chooses the number and type of pointers to be used to read the color data from the image or video. As shown in FIG. 4, the cursor corresponding to the mouse pointer, is moved over the image (or in certain video/pointer combination the image run behind the pointer) and the corresponding x,y coordinates are obtained 50. If point lock is on 52, (as would more likely be the case for a video) the x,y coordinates are set equal to the locked point 54. If autoplay is on 56, the x,y coordinates for the pointer are set equal to a position based on the type of autoplay chosen and the previous position of the pointer 58. In other words, if autoplay is on set on zig-zag, and the last pointer position was 4,5, the pointer coordinates might be set at 5,6. If autoplay is not on, and the particular pointer is not the main pointer, the x,y coordinates are determined as offsets from the x,y coordinates of the main pointer 60.

The RGB color values of the pixel at each x,y coordinate is read from the screen buffer 62 or if the HSB model is employed, the HSB equivalents are obtained, instead 64. If the color values are determined to be outside the desired range to trigger music play 66, e.g., the tolerance is set such that the color change is deemed insignificant, a value indicating no music information is assigned 67 and that value is stored in a temporary scan buffer 68. If, the color values are such that music play is warranted, those values are also stored in the temporary scan buffer 68. They will be retrieved at a later time, during the music calculation process depicted in FIG. 5. Finally, a determination is made as to whether all pointers have been read 70. If not, the sequence returns to the point lock determination 52 and is repeated until all pointers have been calculated.

Color Conversion

Once the particular color value(s) have been obtained, they must be converted into useful musical information corresponding to the particular selected parameters. As shown in FIG. 3, this involves retrieval of the color values stored in the temporary scan buffer 80.

Internal harmonic offsets along the indexed array are first added to the RGB or HSB values 82. If the value is greater than the indexed array's limit 84, the value is set to the array's limit 86. If the value is less than zero 88, the value is set to zero 90. The musical note parameter is calculated for each color voice using the indexed array values and the current scale, key, individual octave (as set via the Orchestrator for each color), external harmony interval (as set via the Orchestrator) and master octave (as set via a keyboard entry to affect all play of any color) 92. All additional harmony voices are then calculated 96. If the value is greater than the upper output limit, the value is set to the upper output limit (the highest note available for play in accordance with all parameters) or reduced by octaves 100. If the value is lower than the lower output limit 102, the value is set to the lower output limit (the lowest note available for play in accordance with all parameters) or raised an octave 104. (Since the output of the present invention need not be a "note" but rather can be any MIDI information, e.g., information to control the operation of a light board, the octave reduction or increase is only relevant when the output information is to be in the form of notes). Finally, the output values are stored in an output array to be used for playing the notes 106 and the calculation routine is repeated for any remaining pointers 108.

Music Play

Once the musical information has been generated and stored in the output array, it is retrieved 110 and processed as shown in FIG. 4. The currently calculated note for each color is first compared to the previous note played for that color 112, 118 and 124. If the note is the same, a determination is made, in accordance with user and system set parameters as to whether the note should be replayed, i.e., re-attacked, or merely continued. If the note is different, or is determined to require re-attack, the status of the particular color is then checked (i.e., on or off) 114, 120 and 126. (In another preferred embodiment, this determination could be done before the comparison with the prior note.)

If the voice associated with the particular color is turned on, the channel number, note and velocity data for the current pointer's main voice for that particular color is retrieved from the system memory 116, 122 and 128. Regardless of the ultimate destination of the output information, e.g., MIDI device, internal sound card or storage to disk, the data comprising the sound to be played is output as a signal. In the case of output destined for a MIDI device, the signal is sent via a serial or parallel port to the MIDI device via a MIDI interface, as required. In the case of output destined for an internal sound card, the signal is sent internally via system calls. In the case of output to be recorded, the signal can either be stored in system memory for later storage to disk or written directly to a disk file. The identical series of steps are undertaken subsequently for any harmony voices 130, 132, 134,136.

After all notes associated with a given pointer have been "played" (actually the notes are output in the form of a signal, not necessarily played as audible sound, yet—that happens in accordance with the various parameters passed to the output device via the signal), a check is made to see if all pointers have been played 138. If not, then the routine is repeated. After all pointers have been played, the system returns to the scanning routine shown in FIG. 4 to obtain new color data.

Preferably, the total cycle, consisting of scanning, calculating and outputting a signal, takes less than 1/60 of a second. If the cycle time is increased, the ability to provide smooth music flow and proper timing may be compromised.

The present invention has been described with reference to certain preferred embodiments, sequential flows and hardware. However, one of skill in the art could conceive of modifications of each without departing from the spirit or intent of the invention.

I claim:

1. A system for generating music from input data comprising: a central processing unit;

an input device connected to said central processing unit; storage means for storing data output by said central processing unit, graphical images for display and commands for directing the operation of said central processing unit; color graphical output means, connected to said central processing unit, for displaying images in response to information input via said input device;

screen buffer means communicating with said central processing unit for storing information corresponding to images displayed on said color graphical output means; sound output means responsive to input from said central processing unit; and conversion means interacting with said CPU for converting selected color data, corresponding to a selected portion of an image displayed on said color graphical output means, into a signal comprising musical information, such that music can be output by said sound output means.

2. A system according to claim 1, wherein said sound output means comprises a MIDI device.

3. A system according to claim 2, wherein said sound output means further comprises a MIDI interface.

4. A system according to claim 1, further comprising at least one pointer means for identifying the portion of a displayed image which is to serve as the source of color data for said conversion means.

5. A system according to claim 4, comprising at least two pointer means.

6. A system according to claim 5, comprising at least three pointer means.

7. A system according to claim 4, further comprising pointer read means for reading the color data identified by each of said pointer means.

8. A system according to claim 7, further comprising sensitivity means for selectively varying the number of times the color data is read by said pointer read means within a given period of time.

9. A system according to claim 8, further comprising tolerance means for selectively determining the amount of change in the color data necessary to cause the generation of musical information.

10. A system according to claim 9, further comprising velocity means for selectively determining the manner of play of notes which correspond to said color data.

11. A system according to claim 10, further comprising at least one primary voice means corresponding to said pointer means for selectively determining an instrument which will influence the sound of at least one note derived from said color data.

12. A system according to claim 11, wherein three primary voice means correspond to each said pointer means.

13. A system according to claim 12, wherein all said selected color data comprises red, blue and green components and wherein said three voice means each correspond to one of said red, green or blue components.

14. A system according to claim 11, wherein at least one harmony voice means corresponds to said pointer means for selectively determining an instrument which will influence the sound of at least one note derived from said color data, wherein said harmony voice means selectively offsets one or more notes to be played from notes derived from said color data.

15. A system according to claim 14, wherein at least one harmony voice means corresponds to each said primary voice means.

16. A system according to claim 14, further comprising orchestrator means for selectively determining harmonic offsets for each said harmony voice means.

17. A system according to claim 16, wherein said harmonic offsets can be fixed, modal or algorithmic.

18. A system according to claim 11, wherein all said selected color data comprises hue, saturation and brightness components.

19. A system according to claim 19, wherein three primary voice means correspond to each said pointer means and wherein said three primary voice means each correspond to said hue component.

20. A system according to claim 11, wherein at least four pointers are available for selecting color data.

21. A system according to claim 20, further comprising at least one duet pointer which follows one of said other pointers.

22. A system according to claim 11, further comprising orchestrator means for selectively directing signals comprising musical information to at least one of a plurality of patches.

23. A system according to claim 11, further comprising scale means for selecting at least one scale to influence the musical information.

24. A system according to claim 23, wherein said scale means selectively provides access to any combination of notes or microtones.

25. A system according to claim 23, wherein said scale means creates an indexed array of scale data based on the particular scales available for selection and the notes available in each scale.

26. A system according to claim 23, further comprising rhythm means for selectively modifying the effect of said sensitivity means.

27. A system according to claim 26, wherein rhythm patterns generated by said rhythm means increase or decrease in speed in proportion to increases or decreases in speed selected via said sensitivity means.

28. A system according to claim 27, further comprising drum means associated with a selected rhythm or color component.

29. A system according to claim 14, further comprising key means for selecting at least one key to influence the musical information.

30. A system according to claim 14, further comprising mixer means for selectively adjusting the volume of each said primary or harmony voice.

31. A system according to claim 4, comprising autoplay means for automatically generating music from an image by automatically moving said pointer means to different points of said displayed image.

32. A system according to claim 31, wherein said automatic movement of said pointer is in accordance with a predetermined pattern.

33. A system according to claim 32, wherein a plurality of predetermined patterns are selectable and include at least one of the following: scan; pattern; circular; zig zag; or scrolling.

34. A system according to claim 33, wherein said plurality of predetermined patterns are subject to selective modification.

35. A system according to claim 31, wherein said automatic movement of said pointer is random.

36. A system according to claim 35, wherein said sound output means comprises a sound card.

37. A system according to claim 1, further comprising music input means for providing an input signal containing music information to said CPU such that said color conversion means converts said input music information into color data for displaying a corresponding image on said graphical display means.

38. A system according to claim 1, further comprising song template means for generating an image in which the color data corresponds to notes of a selected song.

39. A system according to claim 1, further comprising music paint means for generating an image based on selected musical parameters or input music information.

40. A system according to claim 1, further comprising movie control means for selectively controlling the display of images in the form of videos or movies.

41. A system according to claim 40, wherein said movie control means include means to reverse, stop and increase or decrease the frame display of movies or videos displayed as a plurality of sequential frames.

42. A system according to claim 41, wherein said movie control means includes means to move an entire movie or video image around said graphical display means when an image is displayed in space comprising less than the entire portion of said graphical display means.

43. A system according to claim 42, wherein said movie control means can selectively cause the movement of said entire movie or video image in at least one of the following manners: rectilinear, curvilinear, random or input device follow.

44. A method for making music comprising:

providing a preprogrammed computer with data storage and retrieval equipment and at least one input device;

generating signals sufficient to cause the display of a color image on a display;

creating a record of the color value of each addressable point capable of being mapped onto a display;

selecting at least one of said addressable points;

reading the color value of said selected point from said record;

converting the read out color value of said selected point to music information; and sending a signal corresponding to said music information, to sound output means capable of rendering said music information as audible sound.

45. A method according to claim 44, further comprising the step of setting music parameters to influence any final audible sound rendered by said sound output means.

46. A method according to claim 45, further comprising the step of moving at least one pointer over a color image on said display and reading a plurality of color values from at least some of the points passed over by said pointer(s).

47. A method according to claim 46, wherein the x,y coordinates are determined for each point to be read by said pointer(s) and wherein color values corresponding to said x,y coordinates are read directly from said record.

48. A method according to claim 47, further comprising the steps of:

determining whether the read out color values fall within the selected music parameters; and setting music play values based on the read out color values and the selected music parameters.

49. A method according to claim 48, further comprising the step of assigning a music play value indicating no music play when a read out color value falls outside the selected music parameters.

50. A method according to claim 46, further comprising the step of providing at least one primary and one secondary pointer for selective activation.

51. A method according to claim 50, wherein each said secondary pointer is offset from said primary pointer by a selected amount.

52. A method according to claim 51, wherein the value of the x,y coordinates of each said secondary pointer is determined based on an amount by which each is offset from said primary pointer.

53. A method according to claim 46, further comprising the step of storing said music play values in a temporary scan buffer.

54. A method according to claim 46, further comprising the step of setting a tolerance value as a music parameter to determine the amount of change in the color value necessary to cause the generation of music information.

55. A method according to claim 46, further comprising the step of setting a sensitivity value as a music parameter to determine the number of time the color values are read at each pointer location with in a given period of time.

56. A method according to claim 55, further comprising the step of selecting a rhythm to modify the effect of the sensitivity setting.

57. A method according to claim 46, further comprising the step of setting a velocity value to determine the manner of play of notes which correspond to said color values.

58. A method according to claim 46, further comprising the step of assigning at least one primary voice to each said pointer, wherein each said primary voice corresponds to a selected instrument, which instrument influences the sound of at least one note derived from said color values, wherein the selective activation of any of said primary voices causes the generation of music information derived from said color values.

59. A method according to claim 58, wherein three primary voices correspond to each said pointer.

60. A method according to claim 59, wherein said read out color values comprise red, green and blue components and wherein said three primary voices each correspond to one of said red, green or blue components.

61. A method according to claim 60, further comprising the step of selectively assigning at least one harmony voice to each said pointer, wherein each said harmony voice corresponds to a selected instrument, which instrument influences the sound of at least one note derived from said color values, and wherein the selection of any said harmony voice causes the generation of music information derived from said color values which music information corresponds to notes offset from notes corresponding to the music information of one of said primary voices.

62. A method according to claim 61, wherein at least one harmony voice corresponds to each said primary voice.

63. A method according to claim 62, further comprising the step of selecting harmonic offsets for each said harmony voice.

64. A method according to claim 63, wherein said harmonic offsets can be fixed, modal or algorithmic.

65. A method according to claim 59, wherein said read out color values comprise hue, saturation and brightness components and wherein said three primary voices each correspond to one of said hue component.

66. A method according to claim 46, further comprising the step of selecting at least one scale to influence the musical information.

67. A method according to claim 66, further comprising the step of creating an indexed array of scale data based on the particular scales available for selection and notes available in each scale.

68. A method according to claim 46, further comprising the step of automatically moving at least one pointer over an image on a display to automatically generate music.

69. A method according to claim 68, wherein the movement of said pointer is in accordance with a predetermined pattern.

70. A method according to claim 46, further comprising the step of inputting a signal containing music information and converting said input music information to color values to create an image on a display.

71. A method according to claim 46, further comprising the step of selecting a song comprising particular music information and converting said particular music information into color values to create an image on a display.

72. A method according to claim 46, further comprising the step of selectively controlling the display of images in the form of videos or movies.

73. A system for generating music from input data comprising:

a central processing unit;

at least one input device connected to said central processing unit;

storage means for storing data output by said central processing unit, graphical images for display and commands for directing the operation of said central processing unit;

color graphical output means, connected to said central processing unit, for displaying images in response to information input via said input device;

screen buffer means communicating with said central processing unit for storing information corresponding to images displayed on said color graphical output means;

sound output means responsive to input from said central processing unit;

pointer read out means for selecting and reading out color data from said screen buffer means, wherein said read out color data corresponds to the location of a cursor displayed over an image shown on said color graphical output means at a given time; and conversion means interacting with said CPU for converting selected color data, corresponding to a selected portion of an image displayed on said color graphical output means, into a signal comprising musical information, such that music can be output by said sound output means.

* * * * *